United States Patent [19]

Spruell et al.

[11] 4,373,949

[45] Feb. 15, 1983

[54] METHOD FOR INCREASING VESSEL LINING LIFE FOR BASIC OXYGEN FURNACES

[75] Inventors: Jerry V. Spruell, Grosse Ile, Mich.; Jennings B. Lewis, III, Putnam Valley, N.Y.

[73] Assignee: Union Carbide Corporation, Danbury, Conn.

[21] Appl. No.: 295,122

[22] Filed: Aug. 21, 1981

Related U.S. Application Data

[63] Continuation of Ser. No. 10,315, Feb. 7, 1979, abandoned.

[51] Int. Cl.[3] ..... C21C 5/34

[52] U.S. Cl. ..... 75/60; 75/52; 75/59

[58] Field of Search ..... 75/52, 59, 60

[56] References Cited

U.S. PATENT DOCUMENTS

| | | | |
|---|---|---|---|
| 3,076,703 | 2/1963 | Metz | 75/52 |
| 4,081,270 | 3/1978 | Tichauer | 75/60 |
| 4,149,878 | 4/1979 | Thokar | 75/60 |

OTHER PUBLICATIONS

Kristiarsen, "The Effects of Operating Variables on Sulfur Performance in a BOF Shop", 1976 Open Hearth Proceedings, ISS-AIME, pp. 28–41.

Green, "The Influence of MgO on BOF Slag Fluidity and Its Correlation with BOF Refractory Wear Rate", 1978 NOH-BOS Conference, Chicago.

MacNamara, "Operating Factors that Affect Basic Oxygen Furnace Lining Life", 1970 Open Hearth Proceedings, ISS-AIME, pp. 74–81.

Behrens, "The Effects of Live Properties on Basic Oxygen Steelmaking", *J. Metals*, Jul. 1975, vol. 17, pp. 776–784.

"BOF Steelmaking", 12-Raw Materials (Iron & Steel Society of the American Institute of Mining, (1977).

*Primary Examiner*—P. D. Rosenberg

*Attorney, Agent, or Firm*—Adda C. Gogoris; Lawrence G. Kastriner

[57] ABSTRACT

A method for increasing the life of the refractory lining of a basic-refractory-lined vessel for the production of steel by blowing oxygen into a ferrous melt from above the surface of the melt, comprising:

(a) introducing into the vessel slag forming ingredients, including dolomitic lime, such that the amount of dolomitic lime exceeds the amount normally used, and (b) introducing inert gas into the melt in such manner as to cause intensive interaction between the slag and the melt.

The preferred inert gas is argon.

10 Claims, 2 Drawing Figures

METHOD FOR INCREASING VESSEL LINING LIFE FOR BASIC OXYGEN FURNACES

This application is a continuation of our prior U.S. application: Ser. No. 10,315 filing date Feb. 7, 1979, now abandoned.

BACKGROUND

This invention relates, in general, to a process for refining steel, and more specifically, to an improvement in the basic oxygen process wherein molten steel contained in a vessel is refined by top blowing oxygen into the melt, i.e. from above the melt surface.

One problem frequently encountered in making basic-oxygen steel is the limited life of the vessel's refractory lining. It is periodically necessary therefore to reline the vessel, incurring loss of production and relining expense.

Prior methods of improving lining life have been to add dolomitic lime to the slag, see for example Kristiansen et al, "The Effects of Operating Variables On Sulfur Performance in a BOF Shop," 1976 *Open Hearth Proceedings,* ISS-AIME, pp. 28–41. However, too much dolomitic lime renders the slag too viscous for efficient sulfur removal.

OBJECTS

Accordingly, it is an object of this invention to increase the life of refractory linings for basic oxygen vessels.

It is another object of this invention to increase the life of refractory linings for basic oxygen vessels without interfering with the ability to make steel having a low sulfur content.

SUMMARY OF THE INVENTION

The above and other objects, which will readily be apparent to those skilled in the art, are achieved by the present invention, which comprises:

a method for increasing the life of the refractory lining of a basic-refractory-lined vessel for the production of steel by blowing oxygen into a ferrous melt from above the surface of the melt, comprising:

(a) introducing into the vessel, slag forming ingredients, including dolomitic lime, such that the amount of dolomitic lime exceeds the amount normally used, and (b) introducing inert gas into the melt in such manner as to cause intensive interaction between the slag and the melt.

The term "inert gas" as used throughout the present specification and claims is intended to mean a gas other than oxygen having as many as possible of the following characteristics: low reactivity, low specific heat, absence of objectionable contaminante, and high density. The preferred inert gas is argon. However, if nitrogen contamination of the melt is not a problem, nitrogen or air may be used. Other possible inert gases for use in practicing the invention include helium, neon, krypton, xenon, carbon dioxide, steam, ammonia, and mixtures thereof. However, argon, which may be either commercially pure or crude argon, is by far the most preferred inert gas.

The preferred method of introducing inert gas is through the oxygen lance admixed with oxygen.

DETAILED DESCRIPTION OF THE INVENTION

The iron charged to a basic oxygen furnace typically contains carbon, silicon, sulfur, and other impurities. The main purpose of the oxygen is to remove carbon and silicon from the melt. The silicon is oxidized to silicon dioxide which floats on the surface of the melt. The carbon is oxidized to carbon monoxide gas which escapes from the mouth of the vessel. Slag forming ingredients, typically including high-calcium lime, are added to the melt to form a basic slag. The high-calcium lime, normally containing at least 90 percent by weight of CaO, also removes sulfur by reacting with it to form calcium sulfide. Dolomitic lime, i.e. lime containing at least 30% by weight magnesium oxide, is known to improve the life of a vessel's lining, but in addition, it increases the viscosity of the slag, thereby reducing the amount of interaction between the lime in the slag and the melt. The reduced interaction makes it difficult for the lime to remove sulfur from the melt. Since the conventional solution to the problem of obtaining long vessel lining life makes it difficult to make steel having a sufficiently low sulfur content, the amount of dolomitic lime charged to the vessel for conventional oxygen blowing must be limited.

Figure 1A:
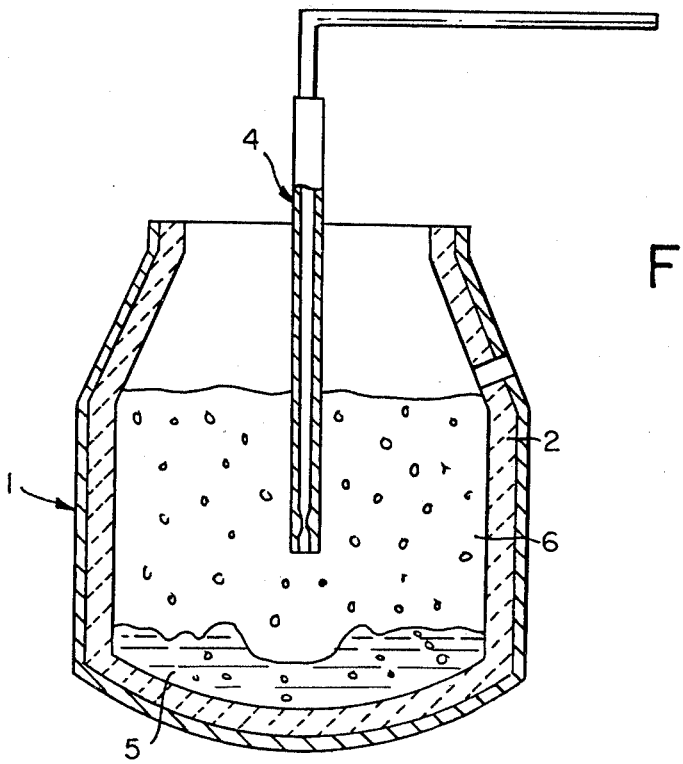
Figure 1B:
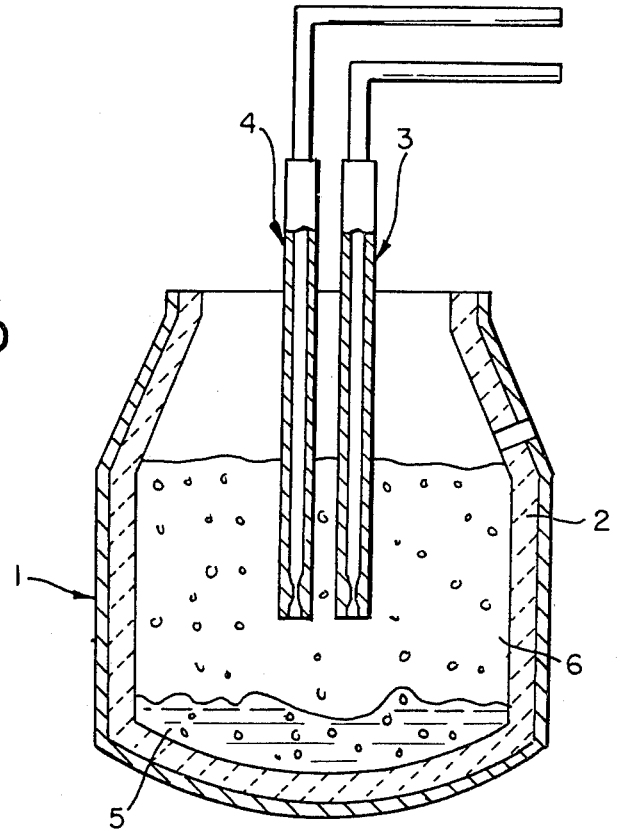

The normal amount of dolomitic lime used for conventional processes varies from zero to about 40% of the total slag-forming ingredients. Typical slag-forming ingredients include high-calcium lime, dolomitic lime, lime stone, and fluorspar. In accordance with the present invention, and with reference to FIG. 1, dolomitic lime is introduced to the slag in an amount exceeding that normally used. That is, each basic oxygen refining system will have a normal amount of dolomitic lime added to the vessel 1 for each grade of steel produced. To practice the present invention the amount of dolomitic lime introduced must exceed the normal amount. Of course, the slag forming compounds should be introduced in an amount sufficient to reduce the sulfur content of the melt 5 to a desired level, based upon the stoichiometric and thermodynamic aspects of the reaction of sulfur with the compounds.

The use of increased amounts of dolomitic lime over that normally used is essential to increasing the life of the vessel's refractory lining 2. Preferably, if high-calcium lime is used to remove sulfur, the amount of dolomitic lime will be at least equal to that of the lime introduced, as shown in the examples to follow. The sulfur content of the steel can be reduced to meet the specification, even if the amount of dolomitic lime is equal to 2 or 3 times the amount of lime introduced.

Extra agitation or mixing is required in the vessel because of the increased slag viscosity caused by the larger amount of dolomitic lime. The extra agitation is provided by introducing inert gas into the vessel in such manner as to cause intensive interaction between the slag and the melt.

The present invention may be practiced in conjunction with the method of Thokar et al for using argon in the BOF or make low nitrogen and low oxygen steel as disclosed in U.S. application Ser. No. 880,562, filed Feb. 23, 1978, now U.S. Pat. No. 4,149,878.

The inert gas must be introduced in such manner as to cause intensive interaction between the slag and the melt. Preferably, as shown on FIG. 1A, the inert gas is introduced through the oxygen lance 4 by metering it (not shown on FIG. 1A) into the oxygen line. Alternatively, as shown on FIG. 1B the inert gas may be introduced through a separate lance 3 directed to impinge oxygen-free fluid against the surface of the melt 5. However, there is no reason for incurring the extra expense of adding a second lance to a basic oxygen vessel.

Since the sulfur content of the melt at the end of the oxygen blow is one of the most difficult variables to control in the basic oxygen process, occasionally, even when the present invention is practiced the sulfur content of the melt at the end of a blow will be higher than desired. However, the sulfur content of the melt may be lowered in accordance with the present invention by adding at least one sulfur-removing compound, such as high-calcium lime, to the slag in the vessel and reblowing the melt with inert gas alone in such a manner as to cause intensive interaction 6 between the slag and the melt until the sulfur content is reduced to the desired level.

If the slag already contains sufficient sulfur-removing compounds, then merely reblowing the melt with inert gas alone in the above described manner may be used to lower the sulfur content to the desired level.

EXAMPLES

The following examples will serve to illustrate the advantage of practicing the invention. A series of heats was performed in a BOF (Basic Oxygen Furnace) system having the following characteristics:

nominal vessel volume: 5,000 cubic feet
tap weight of heat: 235 tons
inert gas used: argon The normal dolomitic lime charge for this vessel was 16,000 lbs. The normal slag-forming ingredients were comprised of 16,000 lbs. of dolomitic lime and 24,000 lbs. of high-calcium lime, and 2,000 lbs. of flurospar.

The dolomitic lime charge was increased to 35,000 lbs. and the high-calcium lime charge was reduced to 10,000 lbs. and argon was injected into the vessel in accordance with the method of addition disclosed in Thokar et al mentioned previously. The argon was injected at a constant rate of 3,500 standard cubic feet per minute during the latter portion of the oxygen blow. As a result of practicing the invention, the life of the lining of this vessel was extended from a previous life of about 780 heats to about 1100 heats. In spite of the very large amounts of dolomitic lime added as slag forming ingredients, no difficulty was encountered making steel having a sulfur content as low as desired. Furthermore, during this test, flurospar, which is known to aid sulfur removal, was not used. In spite of the omission of the normal amount of flurospar, the process was still able to produce steel meeting low-sulfur specifications. Hence, another advantage of the invention is a saving in the amount of fluorspar charged to the vessel. The typical maximum sulfur content allowed by the specifications for steel made by this vessel was 0.025% sulfur.

It can be seen that the practice of the invention yields significant results. The life of the vessel lining was increased to more than 40% beyond that which had been previously obtained for this vessel.

What is claimed is:

1. A method for increasing the life of the refractory lining of a basic refractory-lined vessel for the production of steel comprising: blowing oxygen into a ferrous melt through an oxygen lance from above the surface of the melt, introducing slag forming ingredients into said vessel, including amounts of dolomitic lime that do not substantially interfere with the ability of the slag to remove sulfur from said melt, said amounts of dolomitic lime constituting from 0 to 40 weight percent of the total slag forming ingredients, characterized by:
   (a) introducing additional dolomitic lime into the vessel which would under conventional practice impair the sulfur removing ability of the slag by increasing slag viscosity, and
   (b) introducing sufficient inert gas into the melt to counteract the increased slag viscosity by causing adequate mixing and agitation between the slag and the melt to remove the sulfur from the melt.

2. The method of claim 1 wherein the inert gas is introduced through the oxygen lance.

3. The method of claim 1 wherein the inert gas is introduced through a separate lance directed to impinge the inert gas against the surface of the melt.

4. The method of claim 1 wherein the sulfur content of the melt is higher than desired at the end of the oxygen blow, further comprising the step of:
   (c) reblowing the melt with inert gas alone in such manner as to cause intensive interaction between the slag and the melt until the sulfur content is reduced to the desired level.

5. The method of claim 4 wherein at least one sulfur-removing compound is added to the slag in the vessel prior to the reblowing step.

6. The process of claims 1, 2, 3, 4 or 5, wherein the inert gas is argon.

7. The method of claims 1, 2, 3, 4 or 5, wherein high calcium lime is introduced as a slag forming ingredient in step (b) and the amount of dolomitic lime introduced in step (b) is at least equal to that of the high-calcium lime introduced.

8. The method of claim 7 wherein the amount of dolomitic lime introduced in step (b) is at least two times the amount of high-calcium lime introduced.

9. The method of claim 7 wherein the inert gas is argon.

10. The method of claim 8 wherein the inert gas is argon.

* * * * *

UNITED STATES PATENT AND TRADEMARK OFFICE

CERTIFICATE OF CORRECTION

PATENT NO. : 4,373,949

DATED : February 15, 1983

INVENTOR(S) : J.V. Spruell et al

It is certified that error appears in the above-identified patent and that said Letters Patent is hereby corrected as shown below:

On the front page, in the Assignment Data, after "Conn." insert --and National Steel Corporation, Pittsburgh, Pennsylvania.--

Signed and Sealed this

*Twenty-eighth* Day of *January 1986*

[SEAL]

*Attest:*

DONALD J. QUIGG

*Attesting Officer*

*Commissioner of Patents and Trademarks*